US009080351B2

(12) United States Patent
Helisten

(10) Patent No.: US 9,080,351 B2
(45) Date of Patent: Jul. 14, 2015

(54) DOOR LOCK

(75) Inventor: Mika Helisten, Ylämylly (FI)

(73) Assignee: ABLOY OY, Joensuu (FI)

( * ) Notice: Subject to any disclaimer, the term of this patent is extended or adjusted under 35 U.S.C. 154(b) by 1013 days.

(21) Appl. No.: 12/597,657

(22) PCT Filed: Apr. 24, 2008

(86) PCT No.: PCT/FI2008/050218

§ 371 (c)(1),
(2), (4) Date: Oct. 26, 2009

(87) PCT Pub. No.: WO2008/132275

PCT Pub. Date: Nov. 6, 2008

(65) Prior Publication Data

US 2010/0133856 A1 Jun. 3, 2010

(30) Foreign Application Priority Data

Apr. 27, 2007 (FI) ..... 20075293

(51) Int. Cl.

| | |
|---|---|
| ***E05C 1/02*** | (2006.01) |
| ***E05B 47/06*** | (2006.01) |
| ***E05B 15/00*** | (2006.01) |
| ***E05B 55/12*** | (2006.01) |
| *E05B 47/00* | (2006.01) |
| *E05C 19/02* | (2006.01) |

(52) U.S. Cl.

CPC ..... *E05B 47/0607* (2013.01); *E05B 15/004* (2013.01); *E05B 55/12* (2013.01); *E05B 47/0002* (2013.01); *E05B 2047/0073* (2013.01); *E05B 2047/0076* (2013.01); *E05C 19/02* (2013.01)

(58) Field of Classification Search

USPC ..... 292/144, 251.5

See application file for complete search history.

(56) References Cited

U.S. PATENT DOCUMENTS

| | | | | |
|---|---|---|---|---|
| 4,126,341 | A * | 11/1978 | Bradstock | 292/201 |
| 4,211,443 | A * | 7/1980 | Butts et al. | 292/341.16 |
| 4,824,151 | A | 4/1989 | Taylor | |
| 5,142,890 | A | 9/1992 | Uyeda | |
| 5,437,173 | A * | 8/1995 | Spinar | 70/89 |

(Continued)

FOREIGN PATENT DOCUMENTS

| | | | |
|---|---|---|---|
| AU | 676629 | B2 | 3/1997 |
| DE | 2020626 | A1 | 11/1971 |

(Continued)

OTHER PUBLICATIONS

Marko Keranen, Office action and search report for FI 20075293, Feb. 28, 2008, Finland.

(Continued)

*Primary Examiner* — Mark Williams

(74) *Attorney, Agent, or Firm* — Muncy, Geissler, Olds & Lowe, P.C.

(57) ABSTRACT

The deadbolting means of the lock according to the invention comprise a locking piece (15) to establish and release the locking of the deadbolting means in the deadbolting position. The locking piece is pivotably supported on the lock body (3) and comprises a mechanical control part (19) and at least one electrical control part (20A, 20B). The mechanical control part is functionally linked to a mechanical controller. The electrical control part is functionally linked to an electric actuator.

13 Claims, 3 Drawing Sheets

(56) References Cited

U.S. PATENT DOCUMENTS

Figure 1:
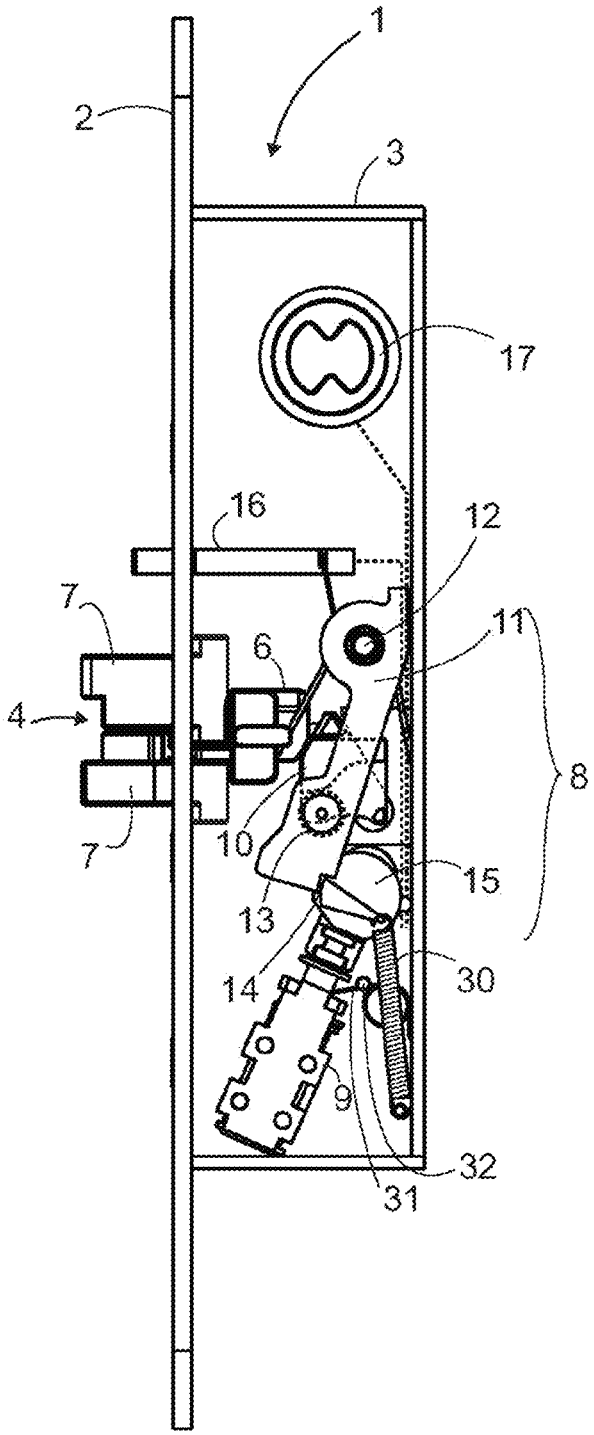

| | | | | |
|---|---|---|---|---|
| 5,953,942 | A * | 9/1999 | Doucet et al. | 70/283 |
| 6,145,898 | A * | 11/2000 | Onderka et al. | 292/228 |
| 6,761,051 | B1 | 7/2004 | Tsai | |
| 6,899,361 | B2 * | 5/2005 | Dorn | 292/332 |
| 2004/0177660 | A1 | 9/2004 | Tsai | |

FOREIGN PATENT DOCUMENTS

| | | | |
|---|---|---|---|
| DE | 10207630 | A1 | 9/2003 |
| DE | 202004002689 | U1 | 4/2004 |
| FI | 871601 | A | 2/1991 |
| GB | 191105427 | A | 1/1912 |
| GB | 2183288 | A | 6/1987 |
| RU | 2079630 | C1 | 5/1997 |
| TW | I220910 | | 9/2004 |

OTHER PUBLICATIONS

Alexandre Bitton, International Search Report and written opinion for PCT/FI2008/050218, Oct. 27, 2008, Netherlands.

* cited by examiner

DOOR LOCK

This is a national stage application filed under 35 USC 371 based on International Application No. PCT/FI2008/050218 filed Apr. 24, 2008, and claims priority under 35 USC 119 of Finnish Patent Application No. FI 20075293, filed Apr. 27, 2007.

FIELD OF TECHNOLOGY

This invention relates to a door lock comprising a lock body fitted with a front plate, a bolt and an electric actuator. The bolt can be moved with reciprocating linear motion between a withdrawn position and a locking position protruding out from the lock body. The electric actuator is used to lock the bolt in the deadbolted position and to release deadbolting.

PRIOR ART

An electrically controlled door lock often uses a solenoid to control deadbolting means in the lock as to lock the bolt in the deadbolted position. In the deadbolted position, the bolt is out; in other words, protruding out from the lock body. The solenoid is also used to release the deadbolting means from the deadbolting position, which allows the bolt to move into the lock body to the withdrawn position.

In prior art solutions, the solenoid is functionally linked to a deadbolting piece that can be moved so that it locks the bolt in the deadbolted position. In a typical implementation, the deadbolting piece is linked to the solenoid shaft, and a spring is used to arrange the shaft to extrude outwards from the solenoid. When the solenoid is de-energised, the spring holds the deadbolting piece in the deadbolting position, and when the solenoid is energised, the solenoid tries to move the deadbolting piece out of the deadbolting position against the spring force. The spring must be sufficiently strong to hold the locking piece securely in the deadbolting position. This, in turn, means that the solenoid must be sufficiently powerful to be able to move the locking piece against the spring force. Another way of implementation is that the lock is locked with the deadbolting piece in the deadbolting position when the solenoid is energised. When the solenoid is de-energised, deadbolting is released.

The lock body usually also has at least one mechanical controller for controlling the position of the locking piece. For example, a cylinder body is arranged to control the locking piece, which means that the locking of the door can be opened using a key. The lock body may also have an auxiliary bolt that is protruding from the lock body when the door is not against the frame of the door opening. The protruding auxiliary bolt prevents the deadbolting means from moving to the deadbolting position, which makes it possible to turn the door to the closed position. There is a spring in connection with the auxiliary bolt that tries to push the auxiliary bolt out of the lock body. The auxiliary bolt is linked to the locking piece. In an implementation where the lock is locked when the solenoid is energised, the auxiliary bolt with its spring counteracts the force of the energised solenoid when the auxiliary bolt is out. Such a situation arises when the door is open and the electrical control to the solenoid tries to lock the lock. Correspondingly, the mechanical parts of a cylinder body linked to the locking piece counteract the force of the energised solenoid when the locking is being opened with a key. Thus, the solenoid must be sufficiently strong to operate as designed in spite of the load of the mechanical controller. On the other hand, the solenoid must not be too strong in order for key operation to be comfortable.

Thus the problem is that different ways of controlling the deadbolting means in the lock have to work against each other in certain everyday operating situations. Another problem is that the lock must be manufactured solely for a certain implementation. In terms of manufacture and stocking, this increases the number of different items.

SHORT DESCRIPTION OF INVENTION

The objective of the invention is to reduce the disadvantages of the above problems. The objective will be achieved as described in the independent claim. The dependent claims describe various embodiments of the invention.

In an embodiment according to the invention, the deadbolting means of the lock comprise a locking piece 15 to establish and release the locking of the deadbolting means in the deadbolting position. The locking piece is pivotably supported on the lock body 3 and comprises a mechanical control part 19 and at least one electrical control part 20A, 20B.

The mechanical control part is functionally linked to a mechanical controller such as an auxiliary bolt or cylinder body. The electrical control part is functionally linked to an electric motor, solenoid, piezo motor or controllable smart metal actuator, for example. The locking piece is arranged so that when mechanical control is used, the locking piece will turn in relation to the lock body without resistance from the electric motor, energised solenoid or other electric actuator functionally linked to the electrical control part.

LIST OF FIGURES

Figure 2:
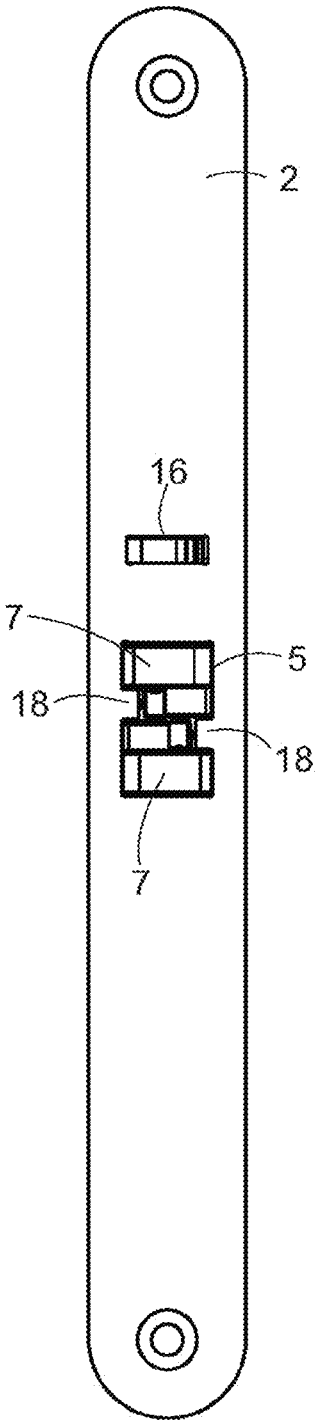
Figure 3:
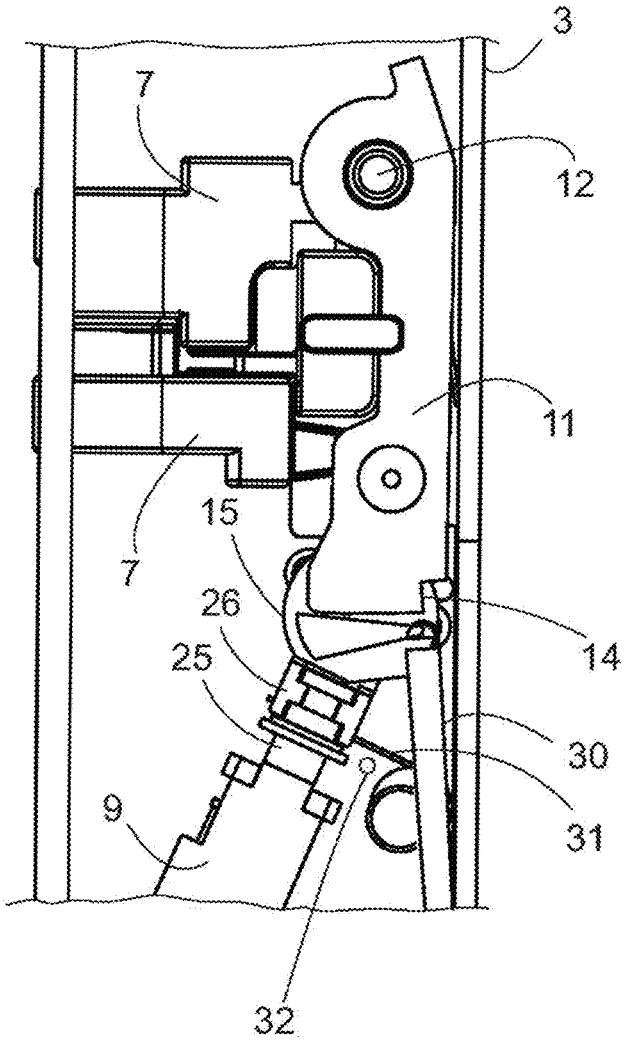
Figure 4:
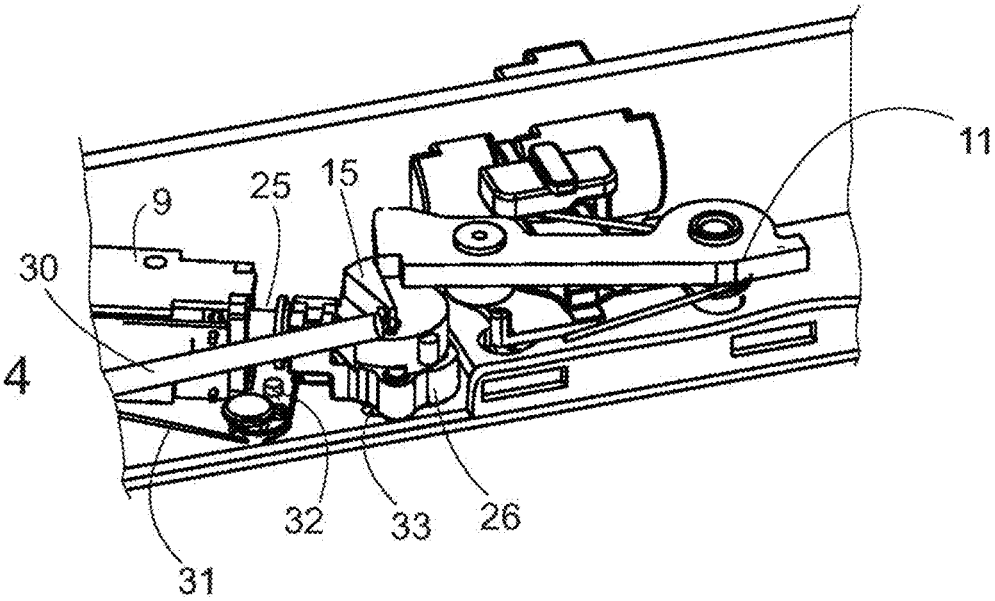
Figure 5A:
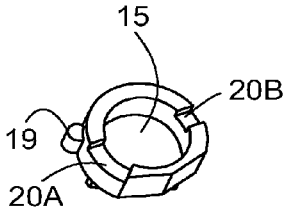
Figure 5B:
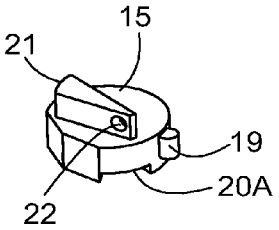
Figure 5C:
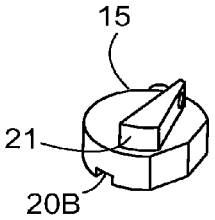
Figure 6:
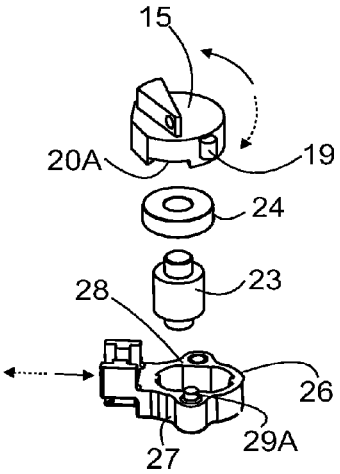
Figure 7:
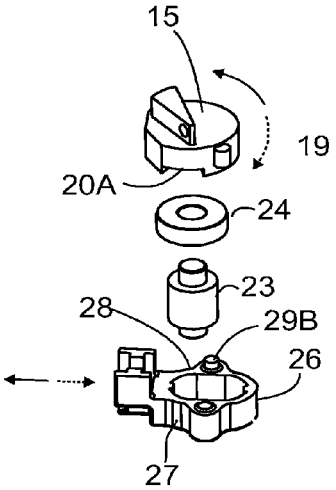

In the following, the invention is described in more detail by reference to the enclosed drawings, where FIG. 1 illustrates an example of a lock according to the invention, FIG. 2 illustrates an example of a lock according to the invention viewed from the front side of the front shield, FIG. 3 illustrates an example of a lock according to the invention with the bolt in the lock body, FIG. 4 illustrates the deadbolting means of the lock, FIGS. 5A-5C illustrate the deadbolting piece according to the invention, FIG. 6 illustrates the mutual operation of the locking piece and shaft element in the safety mode, and FIG. 7 illustrates the mutual operation of the locking piece and shaft element in the secure mode.

Figure 8:
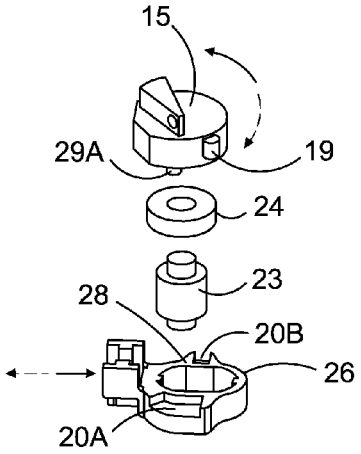

FIG. 8 illustrates an alternative mutual operation of the locking piece and shaft element in the safety mode.

DESCRIPTION OF THE INVENTION

FIG. 1 illustrates an example of a door lock 1 according to the invention. The door lock comprises a lock body 3 fitted with a front plate 2; the lock body has a dual-action bolt 4 that can be moved with reciprocating linear motion between a withdrawn position and a locking position protruding out from the lock body through the bolt opening 5 (FIG. 2) in the front shield 2. The bolt 4 comprises a body part 6 and two bolt pieces 7. The bolt 4 is spring-loaded towards said protruding position. The door lock 1 further comprises deadbolting means 8 that can be moved to a deadbolting position in which they prevent the dual-action bolt from being moved from the protruding position to the withdrawn position in the lock body 3. The lock of this embodiment also comprises a solenoid 9 for controlling the deadbolting means.

The door lock usually also comprises other control means for controlling the deadbolting means. The lock may have an auxiliary bolt 16 and/or control spindle means 17. The auxiliary bolt prevents the bolt from moving to deadbolting when the door is open but allows it when the door is closed. The control spindle means 17 comprises, for example, a cylinder body, a handle and/or a knob. The connection from the control spindle means and auxiliary bolt to the locking piece 15 within the deadbolting means is simply marked with dashed lines. Thus in the embodiment of FIG. 1, the locking piece can be controlled with the solenoid 9, the auxiliary bolt 16 and the control spindle means.

FIG. 2 illustrates an embodiment of a lock according to the invention viewed from the front side of the front plate. It can be seen from the figure that in this embodiment, the edge of the bolt opening 5 has projections 18 that are required for the bolt pieces 7 used in the embodiment. Some other type of dual-action bolt can certainly also be used in a lock according to the invention.

The deadbolting means comprise a wedge 10 between the body part 6 of the bolt and the lock body 3. The wedge is arranged to move transversely to the linear path of the bolt. The deadbolting means also comprise a locking piece 15 and a lever 11 comprising a support point 12, a support surface 13 and a locking surface 14. The lever 11 is pivotably supported on the lock body 3 at the support point 12. The support surface 13 is arranged to interoperate with the wedge 10. The support surface 13 and locking surface 14 can be turned with the lever in relation to the support point 12 between the lever's outward turning position towards the front plate and inward turning position towards the back edge of the lock body. The lever 11 is spring-loaded towards the outward turning position. The locking piece 15 can be moved against the locking surface 14 to lock the lever and wedge in a deadbolting position, in which deadbolting position the lever 11 is in the outward turning position and the support surface 13 is against the wedge 10, and the wedge is wedged between the bolt body 6 and the lock body 3.

FIG. 1 illustrates the lock with the bolt 4 out and the deadbolting means 8 in deadbolting state. In FIG. 3, the bolt is fully inside the lock body; in other words, in the withdrawn position. In FIG. 3, the deadbolting piece 15 is driven to the open position in which it does not prevent the other deadbolting parts from moving into the withdrawn position.

The deadbolting piece 15 receives control from the solenoid 9, the wedge and the control spindle means in the example of FIG. 1. For the purpose of mechanical control, the deadbolting piece has a mechanical control part 19 (FIG. 5A) to which the auxiliary bolt and control spindle means are functionally linked. The locking piece has at least one electrical control part 20A, 20B for the purpose of electrical control, in this case solenoid control. The deadbolting piece 15 is pivotably supported on the lock body 3. The deadbolting piece turns in relation to the support so that the piece does not prevent other parts of the deadbolting means from moving to the withdrawn position when it receives control from the auxiliary bolt 16 or control spindle means 17 linked to the mechanical control part. When control ceases, a spring turns the deadbolting piece back to the deadbolting position.

FIGS. 5A-5C illustrate an embodiment of the deadbolting piece 15. The locking piece comprises a surface 21 to form a locking surface that can be arranged to lock the deadbolting means in the deadbolting position. In this embodiment, the surface is a circular surface, but it may also be a straight surface. The normal line of the circular surface is preferably parallel to the radius of the shaft formed by the support of the locking piece. The locking piece in the figures is a roller that is pivoting in relation to the support to the lock body. The shape of the locking piece can also be different from a roller, for example a bar pivotably supported on the lock body. The mechanical control part 19 is a projection at the edge of the locking piece but can also be a groove. This embodiment has two electrical control parts 20A, 20B, that are grooves. The deadbolting piece also has a spring attachment point 22 for attaching a first spring 30 that tries to turn the deadbolting piece towards the deadbolting position.

The deadbolting piece can also be controlled using a solenoid or other electric actuator. FIGS. 6 and 7 illustrate the operation of electric actuator control. In the embodiment of these figures, the deadbolting piece is pivotably bearing-mounted on the lock body through a pin 23 and a slip ring 24. A shaft element 26 is attached to the shaft 25 of the solenoid/other electric actuator (for example, FIGS. 3 and 4). The shaft is partially inside the solenoid/other electric actuator 9 and can be linearly moved in the shaft direction. When the energised solenoid or other electric actuator pulls the shaft inwards, the shaft element also moves towards the solenoid. When the solenoid/other electric actuator is de-energised, the shaft and shaft element 26 move away from the solenoid by the force of a spring arranged in the lock body.

The shaft element in the embodiment of FIGS. 6 and 7 comprises two arms 27, 28, and the shaft element 26 is functionally linked to the electrical control part 20A, 20B of the locking piece 15 from either one of these arms. The support for the locking piece remains between the arms. In the embodiment illustrated in the figures, the arms of the shaft element are combined to form a ring with the support for the locking piece inside. However, it is not necessary to combine the arms this way. The electrical control part 20A, 20B of the locking piece is a groove. The arm of the shaft element comprises a projection 29A, 29B that can be arranged to a functional connection with the edge of the groove 20A, 20B.

In the embodiment illustrated in the figures, the projection is a screw that can be turned to form a projection and create said functional connection with the edge of the groove. However, a cylindrical pin can be used instead of a screw, for example. There is an arm-specific screw/cylindrical pin for both arms 27, 28, and the locking piece has a screw-specific control groove or electrical control part for the screws/cylindrical pins. The locking piece can be turned by means of the electrical control part through shaft element control—that is, controlled by a solenoid or other electric actuator.

The connection formed by shaft element control to either of the locking piece control parts can be chosen by turning either one of the screws to form a projection while the other screw does not form a projection. FIG. 6 illustrates the choice of the so-called safety mode in which the screw is in connection with the second locking piece groove 20A. In this case the lock operation is arranged so that the lock is in the deadbolted state when the solenoid is energised. Thus the shaft element has been pulled towards the solenoid/other electric actuator in the direction indicated by the straight dashed line, and the locking piece is spring-loaded to turn in the direction indicated by the curved dashed line. The locking piece is now in the locked position. When the solenoid is de-energised, a second spring 31 pushes the solenoid shaft 25 and the shaft element 26 away from the solenoid in the direction of the straight solid line. In this case the screw in the arm turns the locking piece in the direction of the curved solid line, away from the deadbolting position. FIG. 4 illustrates this situation.

FIG. 7 illustrates the choice of the so-called secure mode in which the screw is in connection with the first locking piece groove 20B. In this case the lock operation is arranged so that the lock is in the deadbolted state when the solenoid is de-energised. Thus the shaft element is pushed away from the solenoid, pulled by the first spring 30, in the direction indicated by the straight dashed line, and the locking piece is spring-loaded to turn in the direction indicated by the curved dashed line. The locking piece is now in the locked position. FIG. 1 illustrates this situation. When the solenoid/other actuator is energised, the solenoid pulls the shaft 25 and the shaft element 26 towards the solenoid in the direction of the straight solid line. In this case the screw in the arm turns the locking piece in the direction of the curved solid line, away from the deadbolting position. When the solenoid is de-energised, the first spring 30 turns the deadbolting piece back to the deadbolting position. The turning deadbolting piece simultaneously pulls the solenoid shaft and the shaft element away from the solenoid.

It can be seen from FIG. 4 that the lock body should preferably have a limiter pin 32 that prevents the second spring from pushing against the shaft element 26 when in the secure operating mode (FIG. 1). Thus the same lock can be set into either the safety mode or the secure mode. The lock body also has setting holes 33 for turning the screws 29A and 29B. In a lock according to the invention, the mechanical controllers 16, 17 do not work against an energised electric actuator, and the operation of the deadbolting means is secure.

In the embodiment described above, the projection is in the shaft element and the grooves are in the locking piece, but it is also possible that the electrical control part 20A, 20B of the locking piece is a projection and that the arm of the shaft element 26 comprises a groove, while the projection can be arranged to a functional connection with the edge of the groove.

In the embodiment of FIG. 8, the two electrical control parts 20A, 20B are projections and the arm of the shaft element is a groove.

Even though the above description is primarily concerned with the use of a solenoid as the electric actuator, a lock according to the invention may also use an electric motor, a piezoelectric motor or a smart metal actuator to control the shaft element 26. The smart metal actuator can be, for example, a so-called MSM (Magnetically Controlled Shape Memory) device based on a controlled magnetic field. The magnetic field can be controlled electrically. The deadbolting means described above are just one implementation. Thus the deadbolting means 8 can be implemented differently from the above description. The implementation of the deadbolting means is affected by the type of bolt used and the other structures of the lock.

As can be noted, an embodiment according to the invention can be achieved through many different solutions. It is thus evident that the invention is not limited to the examples mentioned in this text. Therefore any inventive embodiment can be implemented within the scope of the inventive idea.

The invention claimed is:

1. A door lock, comprising:

a lock body fitted with a front plate, the lock body having a dual-action bolt that is moveable with reciprocating linear motion between a withdrawn position and a locking position protruding out from the lock body through a bolt opening in the front plate, said bolt being spring-loaded towards said protruding position;

deadbolting means configured to be moved to a deadbolting position in which said deadbolting means prevent the dual-action bolt from being moved from the protruding position to the position withdrawn in the lock body; and both an electric actuator and a mechanical controller to control the deadbolting means, wherein the deadbolting means comprise a locking piece to establish and release the locking of the deadbolting means in the deadbolting position, said locking piece being pivotably supported on the lock body and comprising a mechanical control part and at least one electrical control part, wherein the mechanical control part is connected to the mechanical controller and the electrical control part is connected to the electric actuator, said locking piece being arranged so that when mechanical control is used, turning of the locking piece in relation to the lock body takes place without resistance from the electric actuator, and wherein the electric actuator comprises a shaft that is partially inside the electric actuator, and said shaft is configured to be linearly moved in the shaft direction, and the door lock comprises a shaft element that is connected to the shaft, while the shaft element comprises two arms, and the shaft element is functionally connected to the electrical control part of the locking piece from either of the arms, while a support for the locking piece remains between the arms.

2. A door lock according to claim 1, wherein the electrical control 30 part is a groove and that the arm of the shaft element comprises a projection that can be arranged to a functional connection with the edge of the groove.

3. A door lock according to claim 2, wherein the electrical control part is a projection and that the arm of the shaft element comprises a groove, and said projection can be arranged to a functional connection with the edge of the groove.

4. A door lock according to claim 2, wherein the projection is a screw or a cylindrical pin configured to create said functional connection with the edge of the groove, and there is an arm-specific screw/cylindrical pin for both arms, the arms have a first control groove and a second control groove for the screws/cylindrical pins, and the locking piece can be turned using shaft element control by means of the control groove of either of the arms, the connection from said shaft element control to either of the locking piece control grooves can be chosen by turning either one of the screws/cylindrical pins to form a projection while the other screw/cylindrical pin does not form a projection.

5. A door lock according to claim 4, wherein with the connection chosen for the first control groove, the electric actuator is arranged to release the locking of the deadbolting means formed by the locking piece in the deadbolting position, and with the connection chosen for the second control groove, a de-energized state of the electric actuator is arranged to release the locking of the deadbolting means formed by the locking piece in the deadbolting position.

6. A door lock according to claim 5, wherein the door lock in which the second control groove has been chosen comprises a spring arranged to push the shaft of the electric actuator and the shaft element away from the electric actuator.

7. A door lock according to claim 1, wherein the door lock comprises a first spring that is connected to the lock body and the locking piece and arranged to turn the locking piece in relation to the support towards the locked position of the locking piece.

8. A door lock according to claim 7, wherein the locking piece comprises a circular surface to form a locking surface arrangeable to lock the deadbolting means in the deadbolting position, the normal line of said circular surface being parallel to the radius of the shaft formed by the support of the locking piece.

9. A door lock according to claim 8, wherein the locking piece is a roll that is pivoting in relation to the support.

10. A door lock according to claim 1, wherein the arms of the shaft element are combined to form a ring with the support for the locking piece inside.

11. A door lock according to claim 1, wherein the mechanical controller comprises an auxiliary bolt or a cylinder body.

12. A door lock according to claim 1, wherein the mechanical control part is a groove or projection.

13. A door lock according claim 1, wherein the electrical actuator is a solenoid, electric motor, piezoelectric motor or smart metal actuator.

* * * * *